US005913667A

United States Patent [19]

Smilee

[11] Patent Number: 5,913,667

[45] Date of Patent: Jun. 22, 1999

[54] AMPHIBIOUS GUN STAND

[76] Inventor: Shannon W. Smilee, 3655 Pine Cir., Lake Wales, Fla. 33853

[21] Appl. No.: 08/998,720

[22] Filed: Dec. 29, 1997

[51] Int. Cl.[6] ..... F41A 9/62

[52] U.S. Cl. ..... 42/94

[58] Field of Search ..... 42/94

[56] References Cited

U.S. PATENT DOCUMENTS

| | | | |
|---|---|---|---|
| 3,876,078 | 4/1975 | Gomes et al. | 211/64 |
| 4,345,398 | 8/1982 | Pickett | 42/94 |
| 4,854,066 | 8/1989 | Canterbury, Sr. | 42/94 |
| 4,937,965 | 7/1990 | Narvaez | 42/94 |
| 5,060,410 | 10/1991 | Mueller | 42/94 |
| 5,081,783 | 1/1992 | Jarvis | 42/94 |
| 5,628,135 | 5/1997 | Cady | 42/94 |
| 5,666,757 | 9/1997 | Helmstadter | 42/94 |

*Primary Examiner*—Charles T. Jordan
*Assistant Examiner*—Denise J. Buckley
*Attorney, Agent, or Firm*—George A. Bode; Lisa D. Charouel; Bode & Associates

[57] ABSTRACT

An amphibious gun stand for supporting a hunter's gun in hard or soft terrain and in the ground of a fluid medium while hunting. The amphibious gun stand comprises a vertical telescopic support member, a horizontal ground stabilizer bar, and a gun holder. The vertical telescopic support member has an adjustable length and a lower pointed end wedgeable into the ground, the hard terrain or the soft terrain. The horizontal ground stabilizer bar is perpendicularly coupled to the vertical telescopic support member for maintaining the vertical telescopic support member in a vertical position. The gun holder is pivotally coupled to the vertical telescopic support member and supports a longitudinal length of the gun in a horizontal plane or an upright position. The gun holder is provided with a handle to rotate the barrel of the gun while supported by the gun holder. Furthermore, the barrel of the gun can be pivoted up or down as desired.

14 Claims, 3 Drawing Sheets

AMPHIBIOUS GUN STAND

This application is based on a previous disclosure to the U.S. Patent Office by the same inventor bearing U.S. Disclosure Document No. 408088 filed Nov. 4, 1996.

BACKGROUND OF THE INVENTION

1. Field of the Invention

The present invention relates to gun stands which support guns in the field and, more particularly, to an amphibious gun stand comprising a gun holder coupled to a vertical telescopic support member having one end capable of being inserted into the ground and a horizontal stabilizer bar perpendicularly coupled to the vertical telescopic support member. The horizontal stabilizer bar provides horizontal support for the vertical telescopic support member such that the vertical telescopic support member is stabilized to maintain its vertical position. Furthermore, the horizontal stabilizer bar provides a support surface which the user's feet can engage to exert a force to wedge the lower portion of the vertical telescopic support member into hard terrain or soft terrain. The telescopic properties of the vertical telescopic support member allow the height of the amphibious gun stand to be increased or decreased as desired. The gun holder is provided with a handle to rotate the barrel of the gun while supported by the gun holder. Furthermore, the barrel of the gun can be pivoted up or down as desired.

2. General Background

While hunting, it is common for a hunter to camouflage himself in the back drop of the environment with his gun in his hand sitting and waiting patiently for the prey. However, after a while, it is desirable to put the gun down so that the hunter can relax his hands and arms. Furthermore, while sitting and waiting patiently for the prey, the hunter continuously scans the environment for the prey. Therefore, it is desirable to provide a gun stand to support the gun in the field which would allow the hunters hands to be free from time-to-time. Additionally, it is desirable to provide a gun stand which can be supported in swamp-like terrain and marsh-like terrain and fluid mediums.

Several devices have been patented which are aimed at stands for bows.

U.S. Pat. No. 5,111,800, by Reynolds entitled "BOWHUNTER'S GROUND BOW HOLDER" discloses a bow holder comprising a pole having one end adapted to be inserted into the ground and two spaced dowels which are adjustably coupled to the pole and are used to support the bow.

U.S. Pat. No. 4,896,854, by St. Laurent, entitled "BOW HOLDER" discloses a bow holder which supports bows in an upright position.

U.S. Pat. No. 4,846,140, by DiMartino, entitled "SPIKE STAND FOR COMPOUND ARCHERY BOWS" is directed to a stand for supporting an archery bow. The stand includes a spike member having a pointed end adapted to be driven into the ground and an opposite end connected to a swivellable bracket member attached to the lower limb of the bow by a releaseable clamp.

U.S. Pat. No. 4,474,296, by Hartman, entitled "PORTABLE ARCHERY STAND" discloses an archery stand having a base upon which there are brackets for supporting a bow and a storage facility for holding and storing the arrows.

U.S. Pat. No. 4,360,179, by Roberts, entitled "ARCHERY BOW STANDS" discloses a bow stand for supporting an archery bow in an upright position, which includes a receptacle means than can be adjusted in size to fit the bow and leg means that can easily be connected to or adjusted relative to the receptacle means for supporting the apparatus on a variety of supporting surfaces.

SUMMARY OF THE PRESENT INVENTION

The preferred embodiment of the amphibious gun stand of the present invention solves the aforementioned problems in a straight forward and simple manner. What is provided is an amphibious gun stand comprising a gun holder coupled to a vertical telescopic support member having one end capable of being inserted into the ground and a horizontal stabilizer bar perpendicularly coupled to the vertical telescopic support member. The horizontal stabilizer bar provides horizontal support for the vertical telescopic support member such that the vertical telescopic support member is stabilized to maintain its vertical position. Furthermore, the horizontal stabilizer bar provides a support surface which the user's feet can engage to exert a force to wedge the lower portion of the vertical telescopic support member into hard terrain or soft terrain. The telescopic properties of the vertical telescopic support member allow the height of the amphibious gun stand to be increased or decreased as desired.

The gun stand of the present invention for supporting a hunter's gun while hunting comprises: vertical telescopic support member having an adjustable length and having a lower pointed end wedgeable in the ground; a horizontal ground stabilizer bar perpendicularly coupled to said vertical telescopic support member for maintaining said vertical telescopic support member in a vertical position; and, a gun holder, pivotally coupled to said vertical telescopic support member, which supports a longitudinal length of the gun in a horizontal plane or an upright position.

The gun holder comprises: a bar member having a longitudinal length; a first V-shaped receptacle coupled to one distal end of said bar member and radially projecting from a top plane of said bar member; and a second V-shaped receptacle coupled substantially in the center of the longitudinal length of said bar member and radially projecting from the top plane of said bar member.

The gun holder further comprises a butt support member perpendicularly coupled to said bar member for supporting a butt of the gun. The butt support member comprises: a member coupled perpendicularly to said bar member wherein a top portion and a bottom portion are formed above and below said bar member; first and second butt receptacles coupled in spaced relation along said top portion of said member for supporting therein a rear surface of the butt of said gun; and, a grasping member coupled to a distal end of said bottom portion wherein said grasping member projects downward to receive therein a contour of said vertical telescopic support member when said gun holder is in a collapsed position.

The bottom portion of said butt support member provides a handle for rotating said gun holder about said lower pointed end. Thereby, the direction of the gun barrel of the gun can be adjusted as desired as the hunter scans the environment for approaching prey.

The pivotal coupling of the gun holder also allows the gun barrel to be directed upward or downward as desired.

In view of the above, it is an object of the present invention to provide an amphibious gun stand which can be used when wading in a fluid medium while duck hunting or while hunting in marsh-like or swamp-like terrain.

Another object of the present invention is to provide an amphibious gun stand with a gun holder which is pivotally coupled to the vertical telescopic support member. Thereby, the amphibious gun stand can be collapsed by pivoting the gun holder to a collapsed position.

A further object of the present invention is to provide an amphibious gun stand which is easily toted from place-to-place while hunting and which is easily inserted in the ground.

It is a still further object of the present invention to provide an amphibious gun stand comprising a gun holder having a first V-shaped receptacle and a second V-shaped receptacle spaced a predetermined distance from the first V-shaped receptacle and a rearwardly disposed butt support member. Furthermore, the first and second V-shaped receptacles have resilient cushioned jackets coupled to each leg of the V-shaped receptacle to prevent the formation of scratches or other imperfections on the surface of the gun when placed in the first and second V-shaped receptacles and to eliminate noises from surface-to-surface contact of the gun with the V-shaped receptacles when placed in the gun holder.

It is a still further object of the present invention to provide an amphibious gun stand having a vertical telescopic support member pivotally coupled to the gun holder via a pivot bracket. The pivot bracket receives a locking pin for locking the gun holder in place to support the gun essentially in the horizontal plane. Upon removal of the locking pin, the gun holder can be easily pivoted to a collapsed state.

It is a still further object of the present invention to provide a vertical telescopic support member comprising a stationary support member having the lower end thereof pointed. The pointed lower end allows the stationary support member to be wedged into hard or soft terrain. The stationary support member slidably receives therein a telescopic member. The height of vertical telescopic support member can be continuously increased by sliding a desired length of telescopic support member out of stationary support member and lock telescopic support member to the desired length via a locking member.

In view of the above objects, it is a feature of the present invention to provide an amphibious gun stand which is relatively simple structurally.

It is another feature of the present invention to provide an amphibious gun stand which is simple and inexpensive to manufacture.

It is a further feature of the present invention to provide an amphibious gun stand which is easy to use, tote and setup in any hunting environment.

It is a still further feature of the present invention to provide an amphibious gun stand which can be wedged and supported in hard terrain, soft terrain such as swamp-like or marsh-like terrain and in fluid mediums.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
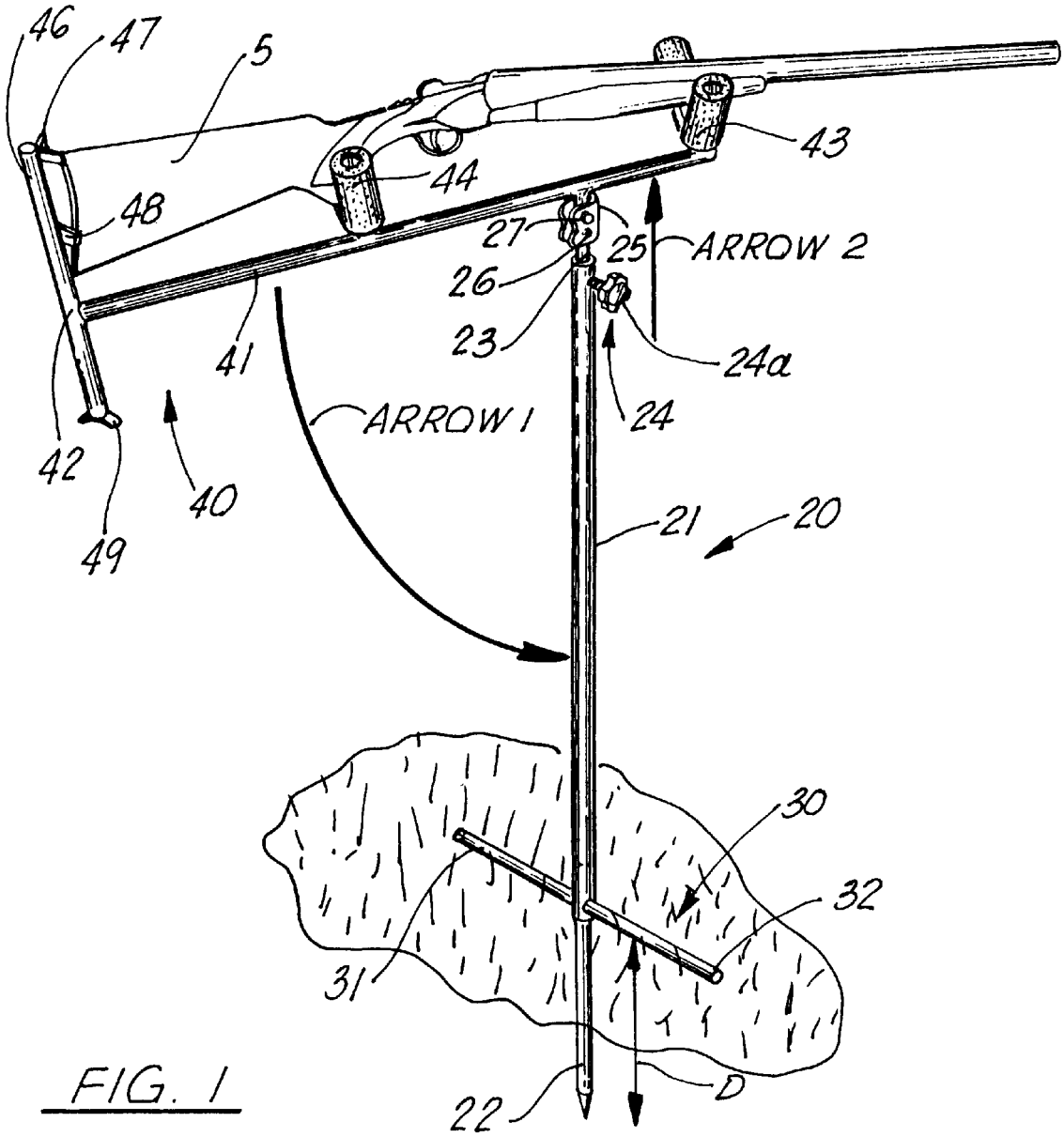
FIG. 1 is a perspective view of the amphibious gun stand of the preferred embodiment of the present invention in use supporting a hunter's gun.
Figures 2, 4:
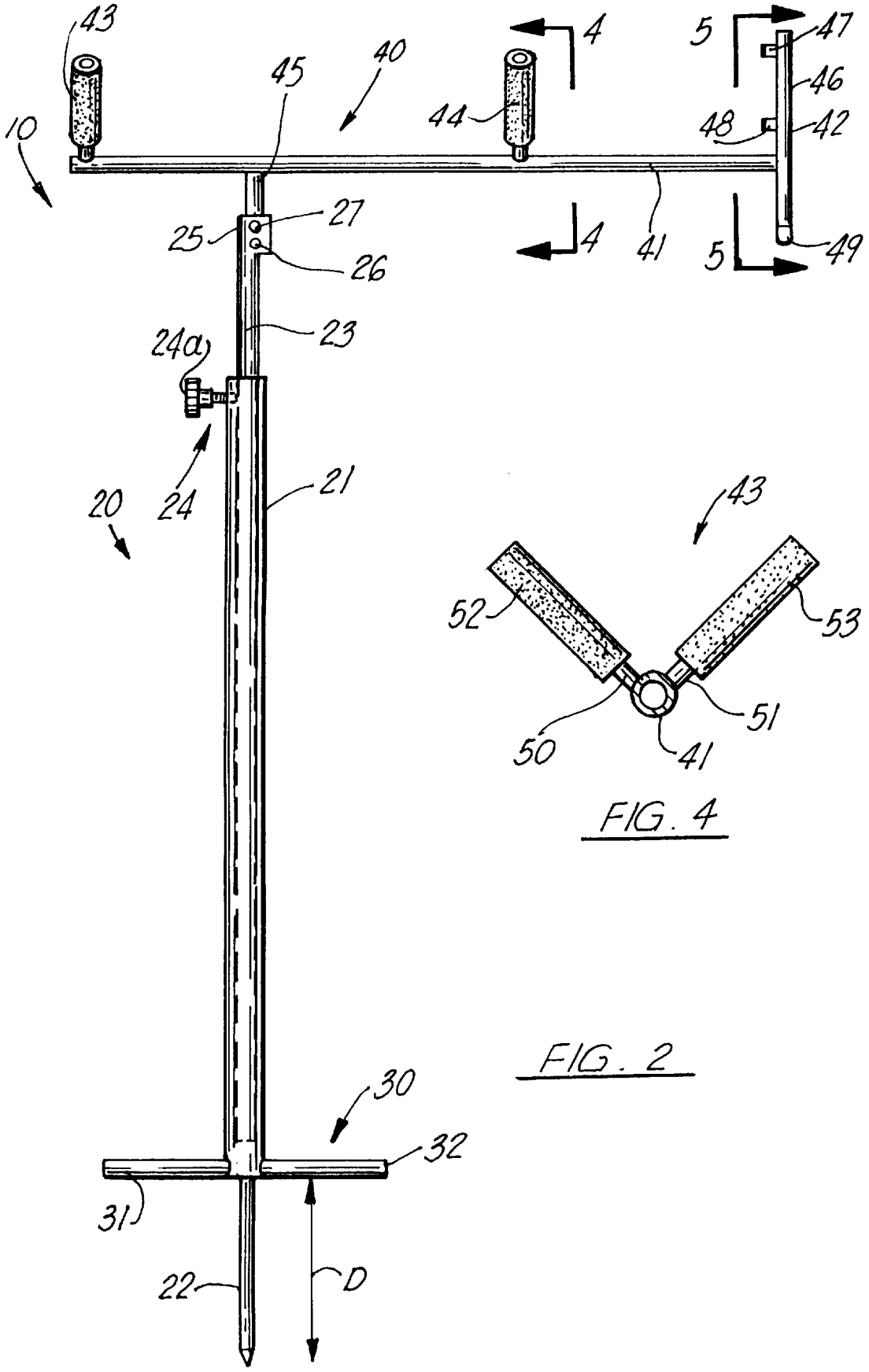
FIG. 2 is a side view of the amphibious gun stand of the preferred embodiment of the present invention.
FIG. 4 is a cross-sectional view along the plane of 4—4 of FIG. 2 illustrating the V-shaped receptacle of the present invention; and, FIG. 5 is a cross-sectional view along the plane of 5—5 of FIG. 2 illustrating the front view of the butt support member of the present invention.

Referring now to the drawing, and in particular FIGS. 1–5, the amphibious gun stand of the present invention is designated generally by the numeral 10. Amphibious gun stand 10 is generally comprised of vertical telescopic support member 20, horizontal ground stabilizer bar 30 and gun holder 40.

Vertical telescopic support member 20 comprises stationary support member 21 having a lower pointed end 22 and telescopic member 23. Pointed lower end 22 allows stationary support member 21 to be wedged a predetermined distance D into hard or soft terrain. Stationary support member 21 slidably receives therein telescopic member 23. The height of vertical telescopic support member 20 can be continuously increased by sliding a desired length of telescopic support member 23, in the direction of ARROW 2, as best seen in FIG. 1, out of stationary support member 21 and lock telescopic support member 23 to the desired length via locking member 24.

In the preferred embodiment, locking member 24 is a screw having knob 24*a*. The knob is used to tighten the screw against telescopic support member 23 to secure telescopic support member 23 in position such that telescopic support member 23 does not slide downward under the weight of gun 5 and/or the force of gravity. Furthermore, telescopic support member 23 may be provided with a plurality of spaced apertures which would receive the shaft of the screw to lock telescopic support member 23 in place to the desired length. For example, the length of vertical telescopic support member 20 may be adjusted from three feet to five feet. Nevertheless, any desirable lengths may be used.

The top end of telescopic support member 23 has coupled thereto pivot bracket 25 for pivotally coupling gun holder 40 to the top end of telescopic support member 23. Pivot bracket 25 has coupled thereto pivot pin 26. Pivot bracket 25 has removably coupled thereto locking pin 27.

Horizontal ground stabilizer bar 30 comprises a first horizontal bar 31 and second horizontal bar 32 each of which radially projects perpendicularly in opposite directions from the circumference of vertical telescopic ground support member 20. More specifically, first horizontal bar 31 is spaced 180° from second horizontal bar member 32.

In operation, lower pointed end 22 of vertical telescopic support member 20 is wedged into the ground, as best seen in FIG. 1. Horizontal stabilizer bar 30 is perpendicularly coupled to vertical telescopic support member 30 a predetermined distance D above the most distal end of lower pointed end 22 to provide horizontal support for vertical telescopic support member 20 such that vertical telescopic support member 20 is stabilized to maintain its vertical position. Furthermore, when wedging lower pointed end 22 in the ground, horizontal stabilizer bar 30 provides a horizontal support surface which the hunter's feet can engage to exert a force to wedge lower pointed end 22 of vertical telescopic support member 20 into hard terrain or soft terrain.

When wedging lower pointed end 22 in soft terrain, horizontal stabilizing bar member 30 may become embedded in the soft terrain until vertical telescopic support member 20 becomes vertically stabilized.

The telescopic feature of vertical telescopic support member 20 allows amphibious gun stand 10 to also be used in fluid mediums wherein horizontal stabilizer bar 30 provides the necessary stability to maintain vertical telescopic support member 20 in a vertical position.

Gun holder 40 comprises first bar member 41 having coupled to one distal end thereof butt support member 42. The other distal end has coupled thereto first V-shaped receptacle 43. Second V-shaped receptacle 44 is coupled substantially in the center of the longitudinal length of first bar member 41. First and second V-shaped receptacle 43 and 44 radially project from the top plane of first bar member 41.

Gun holder 40 further comprises connecting bar 45 perpendicularly coupled to the bottom side of first bar member 41 between first V-shaped receptacle 43 and second V-shaped receptacle 44. Connecting bar 45 is pivotally coupled to pivot bracket 25 via pivot pin 26. Connecting bar 45 is locked in pivot bracket 25 via locking pin 27 wherein when connecting bar 45 is locked first bar member 41 is essentially parallel to the horizontal plane. Thereby, when gun 5 is placed in first and second V-shaped receptacles with the butt placed in butt support member 42, gun 5 is held essentially in a horizontal position.

Figure 3:
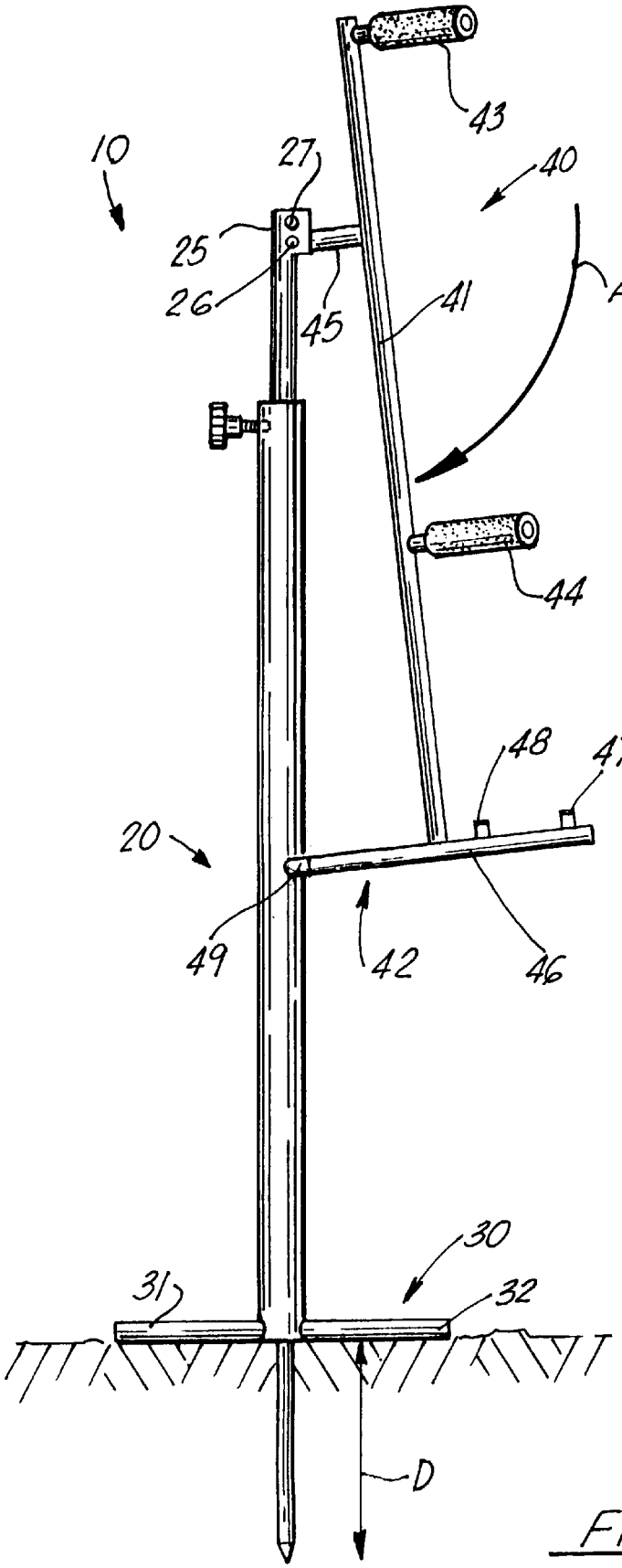
FIG. 3 is a side view of the amphibious gun stand of the embodiment of FIG. 2 in a collapsed state.

When locking pin 27 is removed, connecting bar 45 is free to rotate in the direction of ARROW 1, as shown in FIG. 1 and ARROW 3, as shown in FIG. 3 to place gun holder 40 in a collapsed state, as best seen in FIG. 3.

Since first and second V-shaped receptacles 43 and 44 are identical only one such V-shaped receptacle will be described in detail. As shown FIG. 4, first V-shaped receptacle 43 comprises first angled leg 50 and second angled leg 51 which are coupled to first bar member 41 to form a "V." First angled leg 50 and second angled leg 51 have coupled thereto resilient cushioned jackets 52 and 53, respectively. Thereby, as gun 5 is placed within first V-shaped receptacle 43 and second V-shaped receptacle 44, gun 5 is secured therein. The resilient cushioned properties of jackets 52 and 53 prevent scratches or other imperfections from being formed on the surface of gun 5. Furthermore, the resilient cushioned properties eliminate noises from surface-to-surface contact of gun 5 with V-shaped receptacles 43 and 44 when placed in gun holder 40. Thereby, nearby prey will not be deterred away.

Figure 5:
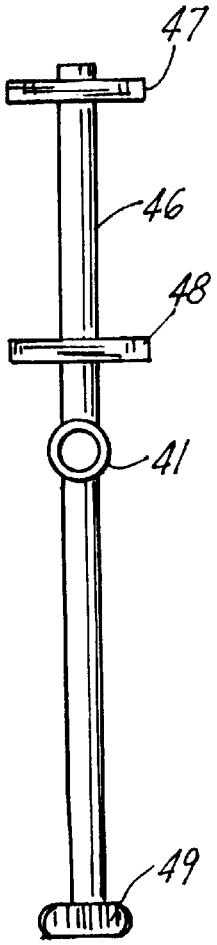

As shown in FIG. 5, butt support member 42 comprises vertical member 46 coupled perpendicularly to first bar member 41 such that a top portion and a bottom portion are formed above and below first bar member 41. The top portion of butt support member 42 has coupled thereto in spaced relation first and second butt receptacles 47 and 48, preferably, V-shaped, for supporting therein the rear surface of the butt of gun 5. Thereby, as gun 5 is placed within first and second V-shaped receptacles 42 and 43, the butt of gun 5 is secured within first and second V-shaped butt supports 47 and 48. The most distal end of the bottom portion of bar member 46 has coupled thereto a semicircular or V-shaped grasping member 49 which projects downward. Henceforth, when gun holder 40 is in the collapsed state, as best seen in FIG. 3, semicircular or V-shaped grasping member 49 receives therein stationary support member 21.

The bottom portion of vertical member 46 provides a handle for rotating gun holder 40 about lower pointed end 22. Thereby, the direction of the barrel of gun 5 can be rotated 360° as the hunter scans the environment for prey. Furthermore, when gun holder 40 is unlocked, the handle can be used to pivot the barrel of gun 5 up and down as desired. The longitudinal length of gun 5 can be secured in an upright position when gun holder 5 is in the collapsed position wherein butt support member 42 prevents the butt of gun 5 from sliding out of gun holder 5 when in the upright position. When gun holder 40 in in the collapsed position, the bottom portion of vertical member 46 slightly angles the longitudinal length such than gun 5 is not fully vertical. The slightly angle longitudinal length of gun 5 is thereby maintained in gun holder 40.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A gun stand for supporting a hunter's gun while hunting comprising:

(a) vertical telescopic support member having an adjustable length and having a lower pointed end wedgeable in a ground;

(b) a horizontal ground stabilizer bar perpendicularly coupled to said vertical telescopic support member for maintaining said vertical telescopic support member in a vertical position; and, (c) a gun holder, pivotally coupled to said vertical telescopic support member, which supports a longitudinal length of the gun in a horizontal plane or an upright position, wherein said gun holder comprises:

(i) a bar member having a longitudinal length;

(ii) a first V-shaped receptacle coupled to one distal end of said bar member and radially projecting from a top plane of said bar member;

(iii) a second V-shaped receptacle coupled substantially in the center of the longitudinal length of said bar member and radially projecting from the top plane of said bar member; and, (iv) a butt support member perpendicularly coupled to said bar member for supporting a butt of the gun, wherein said butt support member comprises:

(A) a member coupled perpendicularly to said bar member wherein a top portion and a bottom portion are formed above and below said bar member;

(B) first and second butt receptacles coupled in spaced relation along said top portion of said member for supporting therein a rear surface of the butt of said gun; and, (C) a grasping member coupled to a distal end of said bottom portion wherein said grasping member projects downward to receive therein a contour of said vertical telescopic support member when said gun holder is in a collapsed position.

2. The gun stand of claim 1, wherein said vertical telescopic support member comprises:

a stationary support member having said lower pointed end wherein said lower pointed end allows said stationary support member to be wedged a predetermined distance into the ground;

a telescopic member slidably coupled in said stationary support member wherein as said telescopic member is slid out of said stationary support member said adjustable length of said vertical telescopic support member is increased; and, a locking member for locking said telescopic member in stationary support member.

3. The gun stand of claim 2, wherein said horizontal stabilizing bar is perpendicularly coupled to said stationary support member said predetermined distance from a distal end of said lower pointed end, said horizontal stabilizing bar comprises:

a first horizontal bar perpendicularly coupled to said stationary support member; and, a second horizontal bar perpendicularly coupled to said stationary support member 180° from said first horizontal bar and wherein said horizontal stabilizing bar provides a horizontal support surface which the hunter's feet can engage to exert a force to wedge said lower pointed end into the ground.

4. The gun stand of claim 1, wherein said first V-shaped receptacle and said second V-shaped receptacle each comprise:

a first angled leg radially projecting angularly from said bar member;

a second angled leg radially projecting angularly from said bar member;

a first resilient cushioned jacket coupled to said first angled leg; and, a second resilient cushioned jacket coupled to said second angled leg.

5. The gun stand of claim 1, wherein said bottom portion of said butt support member provides a handle for rotating said gun holder about said lower pointed end.

6. A gun stand for supporting a hunter's gun while hunting comprising:

(a) vertical telescopic support member having an adjustable length and having a lower pointed end wedgeable in a ground;

(b) a horizontal ground stabilizer bar perpendicularly coupled to said vertical telescopic support member for maintaining said vertical telescopic support member in a vertical position; and, (c) a gun holder, pivotally coupled to said vertical telescopic support member, which supports a longitudinal length of the gun in a horizontal plane or a upright position wherein said gun holder comprises:

(i) a bar member having a longitudinal length, a first V-shaped receptacle coupled to one distal end of said bar member and radially projecting from a top plane of said bar member; and, (ii) a second V-shaped receptacle coupled substantially in the center of the longitudinal length of said bar member and radially projecting from the top plane of said bar member, wherein said gun holder further comprises a butt support member perpendicularly coupled to said bar member for supporting a butt of the gun, said butt support member comprising:

(i) a member coupled perpendicularly to said bar member wherein a top portion and a bottom portion are formed above and below said bar member;

(ii) first and second butt receptacles coupled in spaced relation along said top portion of said member for supporting therein a rear surface of the butt of said gun; and, (iii) a grasping member coupled to a distal end of said bottom portion wherein said grasping member projects downward to receive therein a contour of said vertical telescopic support member when said gun holder is in a collapsed position.

7. The gun stand of claim 6, wherein said vertical telescopic support member comprises:

a stationary support member having said lower pointed end wherein said lower pointed end allows said stationary support member to be wedged a predetermined distance into the ground;

a telescopic member slidably coupled in said stationary support member wherein as said telescopic member is slid out of said stationary support member said adjustable length of said vertical telescopic support member is increased; and, a locking member for locking said telescopic member in stationary support member.

8. The gun stand of claim 7, wherein said horizontal stabilizing bar is perpendicularly coupled to said stationary support member said predetermined distance from a distal end of said lower pointed end, said horizontal stabilizing bar comprises:

a first horizontal bar perpendicularly coupled to said stationary support member; and, a second horizontal bar perpendicularly coupled to said stationary support member 180° from said first horizontal bar and wherein said horizontal stabilizing bar provides a horizontal support surface which the hunter's feet can engage to exert a force to wedge said lower pointed end into the ground.

9. The gun stand of claim 6, wherein said first V-shaped receptacle and said second V-shaped receptacle each comprise:

a first angled leg radially projecting angularly from said bar member;

a second angled leg radially projecting angularly from said bar member;

a first resilient cushioned jacket coupled to said first angled leg; and, a second resilient cushioned jacket coupled to said second angled leg.

10. The gun stand of claim 6, wherein said bottom portion of said butt support member provides a handle for rotating said gun holder about said lower pointed end.

11. An amphibious gun stand for supporting a hunter's gun in a hard or soft terrain and in the ground of a fluid medium while hunting comprising:

(a) vertical telescopic support member having an adjustable length and having a lower pointed end wedgeable in the ground, the hard terrain or the soft terrain;

(b) a horizontal ground stabilizer bar perpendicularly coupled to said vertical telescopic support member for maintaining said vertical telescopic support member in a vertical position; and, (c) a gun holder, pivotally coupled to said vertical telescopic support member, which supports a longitudinal length of the gun in a horizontal plane or an upright position wherein said gun holder comprises:

(i) a bar member having a longitudinal length;

(ii) a first V-shaped receptacle coupled to one distal end of said bar member and radially projecting from a top plane of said bar member;

(iii) a second V-shaped receptacle coupled substantially in the center of the longitudinal length of said bar member and radially projecting from the top plane of said bar member;

(iv) a butt support member perpendicularly coupled to said bar member for supporting a butt of the gun, said butt support member comprising:

(A) a member coupled perpendicularly to said bar member wherein a top portion and a bottom portion are formed above and below said bar member wherein said bottom portion of said butt support member provides a handle for rotating said gun holder about said lower pointed end;

(B) first and second butt receptacles coupled in spaced relation along said top portion of said member for supporting therein a rear surface of the butt of said gun; and, (C) a grasping member coupled to a distal end of said bottom portion wherein said grasping member projects downward to receive therein a contour of said vertical telescopic support member when said gun holder is in a collapsed position.

12. The amphibious gun stand of claim 11, wherein said vertical telescopic support member comprises:

a stationary support member having said lower pointed end wherein said lower pointed end allows said stationary support member to be wedged into the ground, the hard terrain or the soft terrain;

a telescopic member slidably coupled in said stationary support member wherein as said telescopic member is slid out of said stationary support member said adjustable length of said vertical telescopic support member is increased; and, a locking member for locking said telescopic member in stationary support member.

13. The amphibious gun stand of claim 12, wherein said horizontal stabilizing bar is perpendicularly coupled to said stationary support member a predetermined distance from a distal end of said lower pointed end, said horizontal stabilizing bar comprises:

a first horizontal bar perpendicularly coupled to said stationary support member; and, a second horizontal bar perpendicularly coupled to said stationary support member 180° from said first horizontal bar and wherein said horizontal stabilizing bar provides a horizontal support surface which the hunter's feet can engage to exert a force to wedge said lower pointed end into the ground, the hard terrain or the soft terrain.

14. The amphibious gun stand of claim 6, wherein said first V-shaped receptacle and said second V-shaped receptacle each comprise:

a first angled leg radially projecting angularly from said bar member;

a second angled leg radially projecting angularly from said bar member;

a first resilient cushioned jacket coupled to said first angled leg; and, a second resilient cushioned jacket coupled to said second angled leg.

* * * * *